United States Patent [19]

McDermott

[11] Patent Number: 4,543,555

[45] Date of Patent: Sep. 24, 1985

[54] COIL ASSEMBLY FOR HOT MELT INDUCTION HEATER APPARATUS

[75] Inventor: Arthur W. McDermott, Maple Valley, Wash.

[73] Assignee: The Boeing Company, Seattle, Wash.

[21] Appl. No.: 530,924

[22] Filed: Sep. 12, 1983

Related U.S. Application Data

[60] Division of Ser. No. 295,207, Aug. 24, 1981, Pat. No. 4,481,709, which is a continuation-in-part of Ser. No. 260,970, May 6, 1981, Pat. No. 4,420,876.

[51] Int. Cl.[4] ..... H01F 27/30

[52] U.S. Cl. ..... 336/206; 219/10.79

[58] Field of Search ..... 219/10.79; 336/205, 336/206, 223, 232

[56] References Cited

U.S. PATENT DOCUMENTS

| | | | |
|---|---|---|---|
| 3,621,430 | 11/1971 | Shimizu | 336/206 X |
| 3,737,990 | 6/1973 | Schut | 336/205 X |
| 3,845,268 | 10/1974 | Sindt | 219/10.77 |
| 4,146,858 | 3/1979 | McDermott | 336/206 X |

FOREIGN PATENT DOCUMENTS

| | | | |
|---|---|---|---|
| 1099070 | 2/1961 | Fed. Rep. of Germany | 336/206 |
| 1154828 | 9/1963 | Fed. Rep. of Germany | 336/206 |
| 1202902 | 10/1965 | Fed. Rep. of Germany | 336/206 |

*Primary Examiner*—Reinhard J. Eisenzopf
*Attorney, Agent, or Firm*—Conrad O. Gardner; B. A. Donahue; Nicolass DeVogel

[57] ABSTRACT

An induction heating coil having fluoroplastic coated polyimide tape wrapped windings for providing a bonded, solid monolithic structure. The induction heating coil includes a cooling heatsink of predetermined size and shape fused in relationship to a plurality of consecutive turns of current-carrying coil windings. A plurality of fluoroplastic coated polyimide sheets are fused to the coil body between the coil body and a fluoroplastic face sheet forming the outer wear surface of the induction heater coil, thereby providing a non-stick surface for release of hot melt adhesives.

4 Claims, 9 Drawing Figures

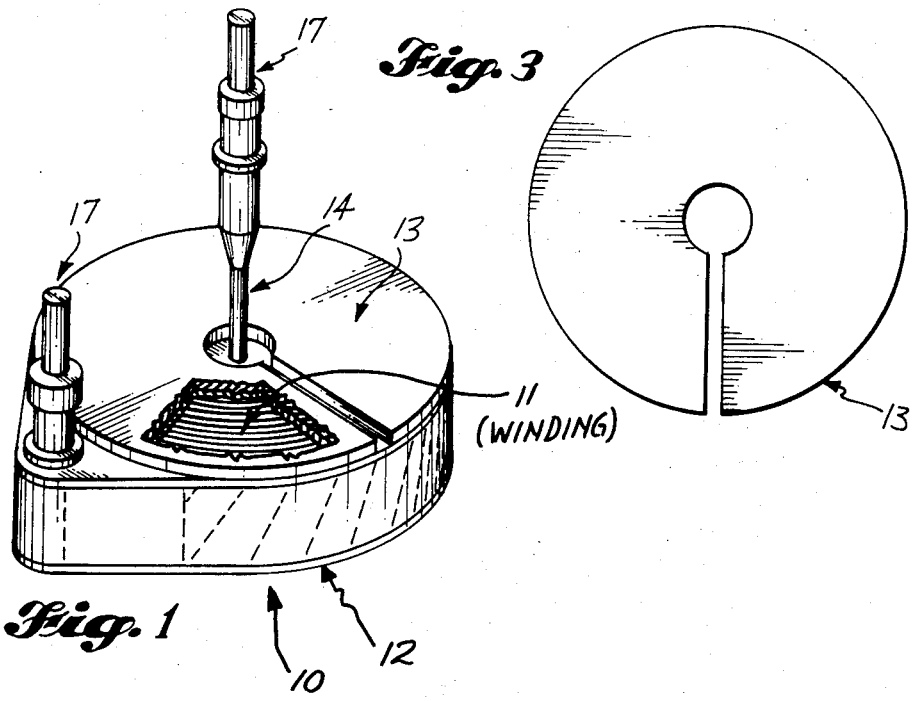
Fig. 3
Fig. 1
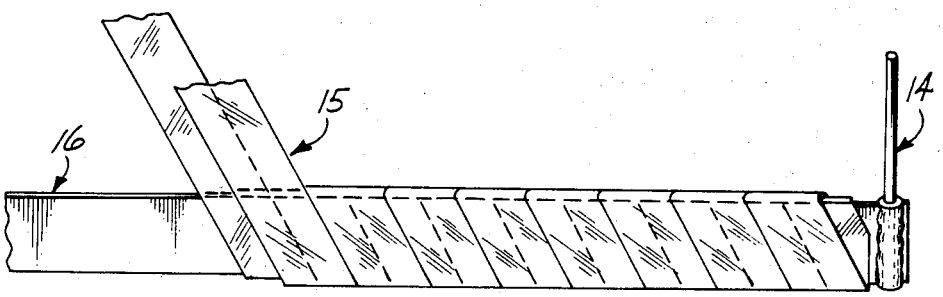
Fig. 2

COIL ASSEMBLY FOR HOT MELT INDUCTION HEATER APPARATUS

This is a division of application Ser. No. 295,207, filed Aug. 24, 1981 now U.S. Pat. No. 4,481,709, which is a continuation-in-part of application Ser. No. 260,970 filed May 6, 1981, now U.S. Pat. No. 4,420,876.

The present invention relates to coil assemblies, and more particularly to the method for making coil assemblies for use in hot melt induction apparatus, such as shown in U.S. Pat. No. 3,845,268, issued to Sindt, also assigned to The Boeing Company.

The prior art induction heater apparatus have included coil assemblies and methods for making coil assemblies such as shown and described in the afore-referenced U.S. Pat. No. 3,845,268. The coil assembly in the aforementioned patent can be seen to comprise 0.004-inch polyimide film spirally wound around 0.010×0.375×80 copper strap to provide insulation between turns of the coil winding. Heat conducting fins shown in the afore-referenced patent comprise three one-inch lengths of #19 conductor flat cable. In the method of providing the coil assembly in the afore-referenced U.S. Pat. No. 3,845,268, the 0.010 thick copper strap is subsequently wound on a ⅜-inch diameter mandrel with adhesive being applied between each turn with cooling fins further interleaved between turns to provide the coil body. Such assembly along with a face sheet is clamped and subsequently cured for about two hours at 180° F. to provide the coil assembly which is subsequently inserted into the coil housing structure.

It is accordingly an object of the present invention to provide electrical insulation between copper strap coil windings comprising double-sided fluoroplastic resin-coated polyimide tape spirally wound around the copper strap induction coil turns, thereby providing an integral monolithic structure of increased bond strength.

It is a further object of the present invention to provide heat dissipation means in an induction heating coil assembly comprising a predetermined mass of conductive material fused to a plurality of current conducting turns.

It is a further object of the present invention to provide a coil assembly including coil body and face sheet which is fused together at a temperature of 700° F. to provide a solid monolithic coil assembly structure.

A full understanding of the present invention, and of its further objects and advantages and the several unique aspects thereof, will be had from the following description when taken in conjunction with the accompanying drawings in which:

FIG. 1 is a perspective view of a preferred embodiment of the present coil assembly made in accordance with the present method, and fused at the predetermined temperature;

FIG. 2 is illustrative of a method step for making the present coil assembly showing the application of double-sided fluoroplastic resin-coated polyimide tape to a copper strap turn winding, further showing a brazed terminal lead;

FIG. 3 is illustrative of a further detail step for making the present coil assembly showing a predetermined mass of conductive material;

Figure 5:
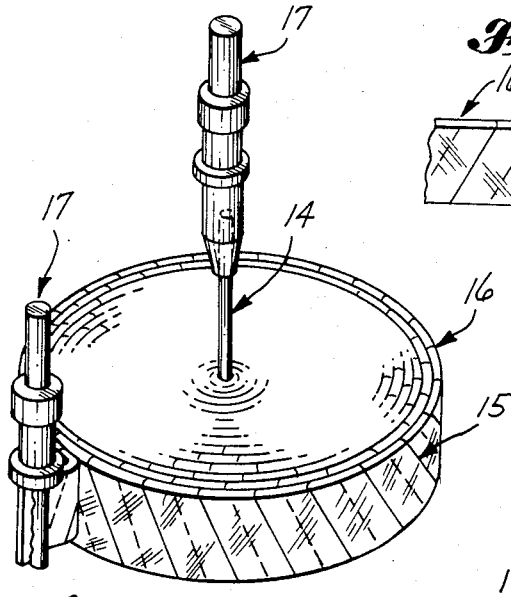
FIG. 5 is a perspective view illustrative of induction coil body subsequent to the winding step.

First, as an introduction, it should be recognized that induction heating type coils differ from EMR (electromagnetic riveting) coils such as shown in prior art U.S. Pat. No. 4,146,858 to McDermott and U.S. Pat. No. 3,737,990 to Schut, both assigned to The Boeing Company, in that induction heating coils are utilized to provide an induction heat source rather than utilization to provide high-strength magnetic force fields to impart physical energy.

The present induction heater coil assembly is shown in perspective in FIG. 1 to help provide a general overview of several important features thereof. It will be noted that the present coil assembly 10 includes insulatively wrapped copper windings 11. The insulative wrapping step of copper windings 11 will be hereinafter described in more detail in connection with the method of making the coil assembly; however, it should be noted here that the insulating wrapping consists of a polyimide tape having double-sided fluoroplastic resin coatings. A doublesided fluoroplastic resin coated polyimide tape called FEP-Teflon Coated Kapton Tape is manufactured by the E. I. Du Pont Company of Wilmington, Del., with nomenclature number 200F919. Also in FIG. 1 shown on the front or face surface which is the working surface of coil assembly 10 is a fused non-stick face sheet 12 which will not adhere to hot melt fasteners. Face sheet 12 may comprise a 0.032-inch thick fluoroplastic resin material also known as TFE-Teflon which is a fluorinated ethylene propylene material manufactured by the E. I. Du Pont Company of Wilmington, Del. Coil assembly 10 in FIG. 1 is also seen to include a solid one-piece cooling heatsink 13 of predetermined mass fused to the top of the insulatively wrapped copper windings 11. An inner high temperature brazed terminal lead 14 is also seen connected between coil assembly 10 via an inner winding 11 to an outer coil connector terminal 17. It should be noted here that the hereinbefore-described structural members when wound insulatively, clamped, and fixtured as described hereinafter in the step-by-step method for making coil assembly 10 provide a coil having a homogeneous mass, superior bond strength, and improved electrical characteristics.

COIL ASSEMBLY 10 FABRICATION PROCEDURE

In the hereinafter-described method of making coil assembly 10, all parts, tools and materials utilized in the fabrication process should be properly degreased, cleaned and handled in a clean environment.

In the step-by-step method for making coil assembly 10, a number 12 bare copper wire having a length of one and one-half inches as shown at 14 in FIG. 2 is brazed to the end of a 0.010×0.375×80 ETP (electrical tough pitch) grade copper strap 16 using 800° F. silver solder (such as manufactured by the Handy/Harmon Company). Subsequent to the brazing of terminal lead 14 to copper strap 16, terminal lead 14 and copper strap 16 are cleaned with MEK (a methyl-ethyl-ketone cleaner), and then abraded with an abrasive pad, e.g., Scotchbrite as manufactured by the 3M Company, to remove all burrs and oxidation.

Figure 4:
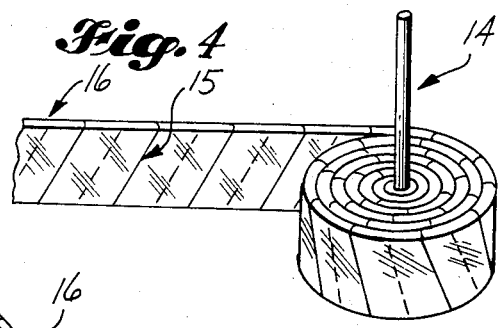
FIG. 4 is illustrative of a method step showing winding of coil body about center terminal lead.

Copper strap 16 is then ready to be spirally wrapped with FEP-Teflon (a fluoroplastic resin, more specifically perfluoroalkoxyethylene) coated Kapton polyimide tape 15 (identified as number 200F919 and manufactured by the Du Pont Company of Wilmington, Del.). As seen in FIG. 2, tape 15 is spirally wrapped about copper strap 16 with an overlap of between about 40 to 50 percent. Terminal lead 14 is now inserted into a ⅜-inch diameter coil winding mandrel, and clockwise turns are made with tape 15 covered copper strap 16 as seen in FIG. 4. Winding the remaining length of copper strap 16 is continued until the entire 80-inch length thereof is fully wound, whereupon the winding is clamped with a restraining ring so that, as seen in FIG. 5, the last ⅜-inch length of copper strap 16 may be bent back and formed at a 90° angle with respect to the coil windings.

Male terminal leads 17 (identified as Part No. 48-1871-02, manufactured by Amphenol-North American, Oakbrook, Ill.) are then soldered to the end of copper strap 16 and to the center terminal lead 14, respectively, utilizing the aforementioned type 800° F. silver solder.

Figure 6:
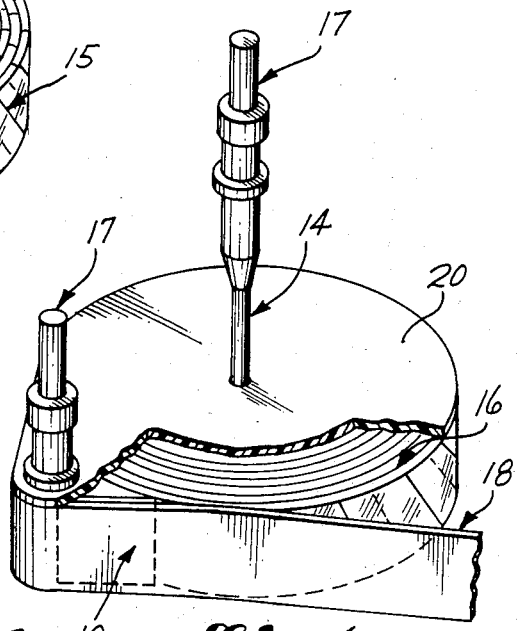
FIG. 6 is a perspective view illustrative of the coil body portion of the assembly further showing back coil body with cover sheets and further showing terminal wedge inserts disposed about the outer brazed terminal lead.

The release clamp restraining ring which holds the coil together (not shown) is then removed, and the outer periphery of the coil is taped with pressure sensitive tape 18 (such as Kapton-100H manufactured by the Du Pont Company of Wilmington, Del.). A pair of terminal wedges 19 (only one shown in FIG. 6) which are made of fluoroplastic resin (identified as TFE-Teflon, manufactured by the Du Pont Company of Wilmington, Del., and known more specifically as fluorinated ethylene propylene) are inserted on the sides of terminal 17 to reinforce and prevent movement thereof whereupon the outside diameter of the coil body is wound with three to six layers of FEP-Kapton tape (#200F919, identified earlier as manufactured by the Du Pont Company of Wilmington, Del.) shown as 15 in FIG. 7.

Figure 7:
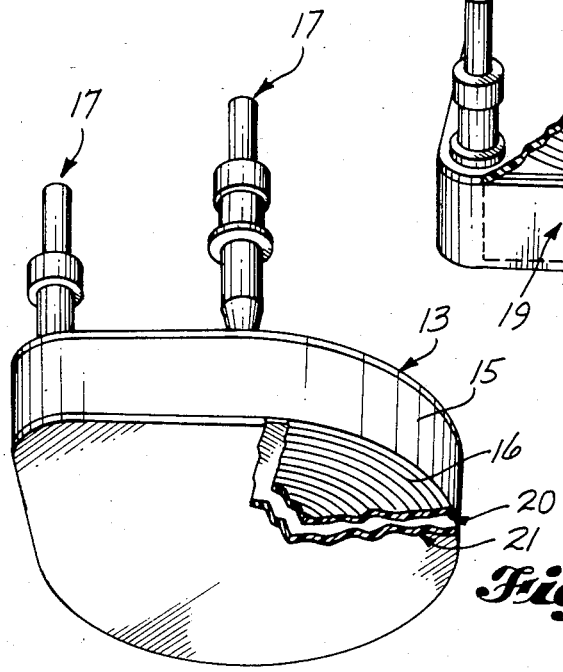
FIG. 7 is illustrative of the coil body subsequent to the method steps of disposing the fluorinated ethylene propylene coated fluoroplastic resin face sheet on the front surface of the coil body and further including a showing of the outer banding in position surrounding the coil body.
Figure 8:
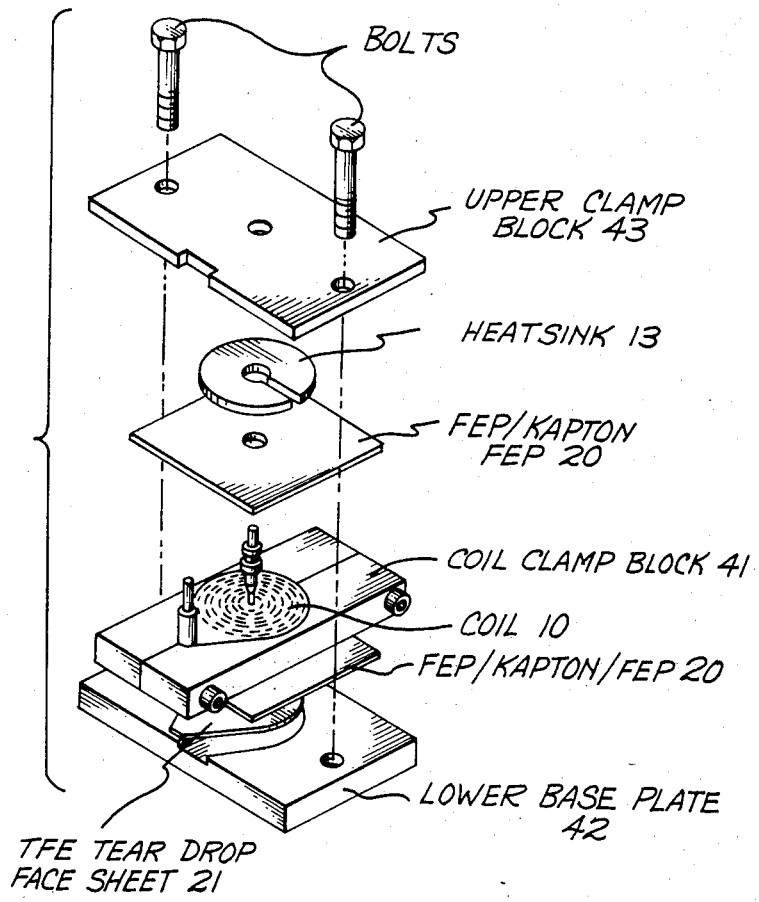
FIG. 8 is an exploded view of the coil fusing fixture also showing the coil assembly disposed therein.

Turning now to the exploded view of the coil fusing fixture shown in FIG. 8, it can be seen that the outside diameter of coil body 10 is clamped with fusing fixture clamp lock 41 whereupon one layer of FEP-Kapton film (type number 300F929, manufactured by the Du Pont Company of Wilmington, Del.) 20 is then applied to both front and back coil faces, followed by application of face sheet 21 (as seen in FIG. 7), fase sheet 21 being a 0.032-inch thick sheet of TFE-Teflon material, a fluoroplastic resin known more specifically as perfluoroalkoxyethylene, and manufactured by the Du Pont Company of Wilmington, Del.

At this point in the fabrication procedure, cooling heatsink 13 as shown in FIG. 3, which cooling heatsink 13 has been previously cleaned and abraded, is placed over center terminal 17, and in contact and centered on coil windings 11. Orientation of the slot is not critical.

Coil body 10 and coil clamp block 41 are then inserted on fusing fixture base plate 42, with coil face sheet 21 centered in the recess. The following steps in the fabrication process are then taken: (1) upper clamp block 43 is positioned over clamp block 41, and (2) then all plates are bolted through utilizing an application of approximately 40-inch pounds torque.

Coil fusing fixture 40 is pre-coated with a parting agent, e.g., Fre-Kote (a parting agent manufactured by the Fre-Kote Manufacturing Company of Boca Raton, Fla.).

Figure 9:
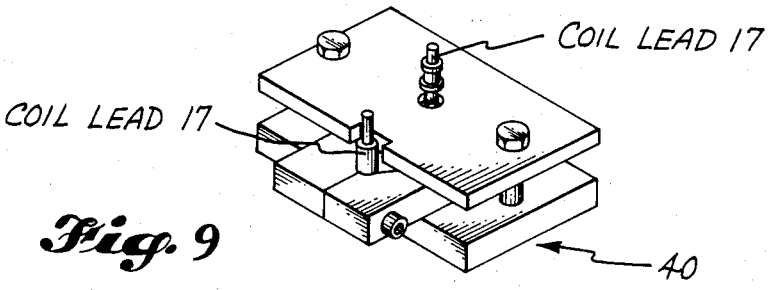
FIG. 9 is illustrative of the assembled coil fusing fixture.

Coil assembly 10, now fixtured in coil retaining fixture 40, is then inserted into a vacuum furnace with coil face down, evacuation is done to a minimum of about 26 to 29 inches Hg., whereupon heat is then applied to a temperature of 650° F.±25° F. for about 30 minutes, and subsequently the temperature is raised to 700° F.±25° F. for about 30 minutes whereupon cooling is done to 225° F. in an inert atmosphere (argon or helium purge preferred). Coil assembly 10 and coil fixture 40 (the assembled coil fusing fixture as shown in FIG. 9) are then removed from the furnace and cooled to room temperature. Coil fixture 40 is then disassembled and coil assembly 10 removed. Excess material flash on the outer edges net to face sheet 21 are then trimmed, thereby completing the fabrication process.

What is claimed is:

1. A coil assembly for use in induction heating apparatus comprising a plurality of windings of a flat shaped electrical conductor, said electrical conductor wrapped with a polyimide tape, said polyimide tape having two major side surfaces, each of said side surfaces having a coating of fluoroplastic material, and, including a fluoroplastic face sheet supported by a major surface of said coil assembly and providing a non-stick surface for release of hot melt adhesive material; said coil assembly further including a heat sink disposed on a major surface of said coil assembly opposite said major surface supporting said fluoroplastic face sheet; and, wherein the stack of elements comprising face sheet (12), a plurality of coated polyimide sheets (20) and a coil body (10), when fixtured (FIG. 8), provides a clamping pressure to insure fusing.

2. A coil assembly for use in induction heating apparatus comprising a plurality of windings of a flat shaped electrical conductor, said electrical conductor wrapped with polyimide tape, said polyimide tape having two major side surfaces, each of said side surfaces having a coating of fluoroplastic material, and, including a fluoroplastic face sheet supported by a major surface of said coil assembly and providing a non-stick surface for release of hot melt adhesive material; said coil assembly further including a heat sink disposed on a major surface of said coil assembly opposite said major surface supporting said fluoroplastic face sheet; and, wherein said fluoroplastic face sheet has a thickness of 32 mils ±2 to 3 mils.

3. The invention according to claim 2 further including a plurality of fluoroplastic coated polyimide sheets fused to and disposed between said face sheet and said major surface of said heating coil.

4. A coil assembly for use in induction heating apparatus comprising a plurality of windings of a flat shaped electrical conductor, said electrical conductor wrapped with a polyimide tape, said polyimide tape having two major side surfaces, each of said side surfaces having a coating of fluoroplastic material, and, including a fluoroplastic face sheet supported by a major surface of said coil assembly and providing a non-stick surface for release of hot melt adhesive material; said coil assembly further including a heat sink disposed on a major surface of said coil assembly opposite said major surface supporting said fluoroplastic face sheet; and, wherein said heat sink comprises a copper slotted washer-like member.

* * * * *